US005765225A

United States Patent [19]

Goeckeritz et al.

[11] Patent Number: 5,765,225

[45] Date of Patent: Jun. 16, 1998

[54] BABY BIB AND BOTTLE HOLDER

[76] Inventors: Rachel Goeckeritz; Joseph Goeckeritz, both of 1043 W. Four B La., South Jordan, Utah 84095

[21] Appl. No.: 811,398

[22] Filed: Mar. 4, 1997

[51] Int. Cl.[6] ..... A41B 13/10; A47D 15/00; A41D 11/00

[52] U.S. Cl. ..... 2/49.1; 248/102

[58] Field of Search ..... 2/49.1, 49.2, 104; 248/102, 103, 104, 105

[56] References Cited

U.S. PATENT DOCUMENTS

| | | | |
|---|---|---|---|
| D. 246,858 | 1/1978 | Larson . | |
| D. 250,048 | 10/1978 | Sussman . | |
| D. 260,289 | 8/1981 | Rubin . | |
| D. 264,130 | 4/1982 | Rubin . | |
| D. 290,794 | 7/1987 | Mingeldorff, Jr. . | |
| 298,985 | 5/1884 | Kimball | 2/49.2 |
| D. 299,750 | 2/1989 | Garcia et al. . | |
| 530,435 | 12/1894 | Lowerre | 248/102 |
| 1,617,944 | 2/1927 | Gerstner | 248/102 X |
| 2,134,746 | 11/1938 | Allen | 248/102 |
| 2,485,461 | 10/1949 | Siegel . | |
| 2,510,953 | 6/1950 | Brose et al. | 248/102 |
| 2,522,120 | 9/1950 | Kaskey et al. | 248/102 X |
| 2,526,121 | 10/1950 | Curry et al. . | |
| 2,631,288 | 3/1953 | Daust . | |
| 2,880,950 | 4/1959 | Williams et al. . | |
| 3,425,653 | 2/1969 | Rauch . | |
| 3,512,301 | 5/1970 | Kramer . | |
| 3,539,140 | 11/1970 | Tuttle . | |
| 3,584,818 | 6/1971 | Essman . | |
| 3,620,491 | 11/1971 | Baclit . | |
| 3,635,430 | 1/1972 | Emond et al. . | |
| 3,696,233 | 10/1972 | Pulsifer . | |
| 3,718,360 | 2/1973 | Knutzen . | |
| 3,905,571 | 9/1975 | Lombardo | 248/102 |
| 4,564,957 | 1/1986 | Scharf . | |
| 4,809,938 | 3/1989 | Skinner et al. | 248/102 |
| 4,895,327 | 1/1990 | Malone et al. | 248/102 |
| 4,953,816 | 9/1990 | Wilkinson . | |
| 5,042,758 | 8/1991 | Roy et al. . | |
| 5,048,121 | 9/1991 | Kordecki . | |
| 5,183,229 | 2/1993 | Duggan | 248/102 |
| 5,188,320 | 2/1993 | Polka . | |
| 5,217,192 | 6/1993 | Oktayuren . | |
| 5,265,834 | 11/1993 | Daniels . | |
| 5,312,282 | 5/1994 | Cooper . | |

FOREIGN PATENT DOCUMENTS

| | | | |
|---|---|---|---|
| 2030121 | 5/1992 | Canada | 248/102 |

*Primary Examiner*—C. D. Crowder
*Assistant Examiner*—Shirra L. Jenkins
*Attorney, Agent, or Firm*—Dick and Harris

[57] ABSTRACT

A baby bib having a bottle holding capability. The bib has an attached bottle-holding structure which maintains a baby bottle in a predetermined position, both laterally and longitudinally. The bottle holding attachment is made of a soft structural material covered with a fabric material similar to the bib fabric. The bottle holder may also be made with a harness attached to it so that it may be held in place without being attached to a bib.

6 Claims, 2 Drawing Sheets

BABY BIB AND BOTTLE HOLDER

TECHNICAL FIELD

This invention relates to holders for baby bottles which positions the bottle in close proximity to an infant's mouth.

BACKGROUND

Various types of baby bottle holders have been described in numerous patents. Many such holders are rigid frames which set over an infant, often confining movement of the infant's arms, or having a bottle or the device positioned where it could be knocked over by the infant swinging its arms. Examples of such devices are illustrated in the following U.S. Patents: Des. Pat. No. 290,794 to Mangledorff, Jr., U.S. Pat. No. 3,620,491 to Baclet, and U.S. Pat. No. 5,188,320 to Polka.

Other bottle holders are designed to attach to something such as a pillow or crib. Examples of such devices are illustrated in U.S. Pat. No. 3,696,233 to Pulsifer, U.S. Pat. No. 3,635,430 to Emond et al., U.S. Pat. No. 3,539,140 to Tuttle, and U.S. Pat. No. 3,425,623 to Ranch.

Other holders do not attach to anything and are constructed primarily to tilt a bottle. Such devices are illustrated in U.S. Pat. No. 3,584,818 to Essman, U.S. Pat. No. 3,512,301 to Kramer and U.S. Pat. No. 5,217,192 to Oktaymen.

A soft pad-type holder for use with an infant in a vehicle safety seat is disclosed in U.S. Pat. No. 4,953,816 to Wilkinson. It is essentially a bib with a cut-out section, referred to as a yoke, at the top of the bib. The bib is held in place by interacting members, such as VELCRO® swatches, which adhere to the baby seat traps holding the infant in place. The yoke is closely adjacent an infant's mount when the infant is positioned in the seat. The yoke, apparently, forms a rest upon which the bottle rests while an infant is holding it. From all appearances of the structure, it is necessary for an infant to grip the bottle to keep it in position.

U.S. Pat. No. 2,526,121 to Curry et al. discloses a nursing bottle holder having a shallow, dished structure, which, without straps, provides no lateral support over substantially the whole height (width) and length of the baby bottle. The holder of Curry et al. also has transverse straps over the top, but has no support member at the foot of the holder to prevent the bottle from being displaced longitudinally.

Unfortunately, due to these structural features, Curry's holder cannot readily be used in any position other than a prone position since the bottle on such a holder, especially with pressure from a baby's mouth, would be displaced longitudinally when the baby is reclined at an angle of, for example, 45°.

U.S. Pat. No. 5,048,121 discloses still another baby bottle holder. However, Kordecki lacks attachment means on the face of the bib, and Kordecki's bottle holding device is secured to a bib. Kordecki's bib slides into a slot of the holder and is positioned there, but lacks securing or attaching relationship between Kordecki's bib and holder.

It would be an improvement in the art to have a baby bottle holder that is washable, easily removed, and more comfortable to the infant, yet is more stable (e.g. it remains in place) when the infant is in various positions.

SUMMARY OF THE INVENTION

The instant invention comprises an unique device for holding a baby bottle in a proper position for a suckling infant in a sitting or reclining position. The bottle holding device is constructed to fit securely to the infant so that the bottle is not easily displaced laterally or longitudinally.

An unique device for holding a baby bottle in a substantially fixed position relative to an infant's body has been invented. The bottle holder has an elongated, longitudinal channel into which either a small or large baby bottle may be inserted. The bottle holder is constructed of material which is self-supporting and sufficiently strong to hold a baby bottle in a substantially fixed position with respect to an infant's body so that the nipple remains in close proximity to a sucking baby's mouth.

The bottle holder of the instant invention may be equipped with straps to form a harness to hold it on the chest of a reclining baby. The harness may be fashioned to fit over the shoulders and around the torso of an infant so the bottle holder remains on the baby's chest even though the baby may be moving its arms and legs or w torso. Alternatively, the bottle holder may be made as an attachable, detachable device which is secured to a bib or other article of clothing of the infant.

A baby bib having a baby bottle holding attachment has been invented. The bib may be of a conventional bib shape and fabric construction. The bottle holding attachment may be an integral part of the bib or it may be detachable. Also, the bottle holding structure may be constructed so that it need not be attached to a bib in order to hold a baby bottle in a proper position for a suckling infant.

The bottle holding structure is a generally U-shaped channel-like member in which a bottle may be nested in the trough of the "U" so that the wall of the "U" shaped-channel member holds the bottle to prevent lateral displacement. The U-shaped channel-like member is preferably constructed of a soft material.

BRIEF DESCRIPTION OF THE DRAWINGS

In the drawings, which depict presently preferred embodiments of the invention and in which like reference numerals refer to like parts in different views.

BEST MODE OF THE INVENTION

Figure 1:
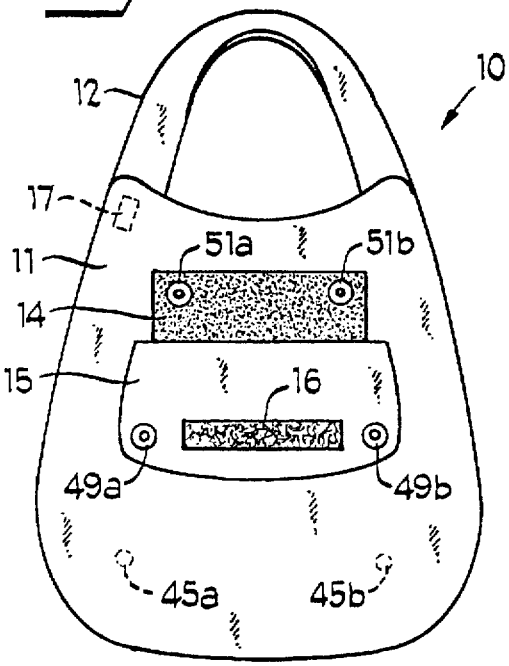
FIG. 1 is a planar view of a bib for use with the invention.

In one embodiment of the invention, the bottle holding device is attachable to a bib. A suitable bib, generally 10, for such purposes is illustrated in FIG. 1. The bib 10 has a face panel member 11 sized to cover generally the chest and abdomen of an infant. The bib is held in place on an infant by a neck loop 12 at the top of the panel member and by, preferably, spring-loaded clips 13*a* and 13*b* attached (e.g. by eyelets 45*a*, 45*b*) near the lower edge of the panel member (see FIG. 10). Neck loop 12 has a swatch 17 (shown in construction lines) made of a synthetic material which adheres to an interacting material (e.g. interacting VELCRO® swatches) attached at its free end which mates with an interacting (e.g. a corresponding VELCRO® swatch) member on the rear side of panel 11.

The panel member 11 is generally made from a soft fabric such as cotton, synthetic fibers, or the like, although it may be made of a flexible plastic material. The bib panel member may be of any convenient geometrical shape such as a rectangle with rounded corners. The panel member 11 may have a back panel (not shown). Thus, the bib may be made with a back panel and a face panel stitched together to form a bib with a double or multiple layer structure. It may, of course, be a single layer of material.

The bib 10 of FIG. 1 has an article accepting region or attachment means 14 on the face panel 11 of the bib. The attachment means 14 illustrated is an interacting member (e.g. a VELCRO® swatch) positioned a short distance below the top edge of the bib. Generally, the distance below the top edge is from about one to three inches. The size of the swatch (or swatches) is such that it is sufficiently large to hold the bottle holding device with a similarly-sized, interacting (e.g. VELCRO®) swatch securely to the bib. For example, the size of the swatch 14 may be about two to four inches in width and about one to three inches in height, and may be stitched, adhered or otherwise associated with the face panel 11 of the bib 10.

A flap 15, generally of cloth or plastic, is secured along its upper edge (i.e. the edge closest to the swatch 14) to the bib face panel. Flap 15 also has an interacting (e.g. VELCRO®) swatch 16. Flap 15 may be swung upwards so that swatch 16 mates with swatch 14 to present a smooth surface along the whole face of the bib. The interacting swatch 14 could be left exposed, i.e. no flap 15, however, threads, food etc. may be collected by the interacting swatch 14 thus making an unsanitary and unsightly collector on the bib. The flap 15 provides a means for enabling the article accepting region 14 to be altered from a first covered non-article accepting orientation to a second uncovered usable article accepting orientation.

The clips 13*a* and 13*b* at the lower edge of the panel member are used to secure the bib to an infant's pajamas, playsuit, diapers or the like. Because of the weight of a filled baby's bottle and the desire to hold the bottle nipple in fixed relation to the infant's mouth, it is necessary that the bib not move, or move only slightly, in relation to the infant's head and body. The neck loop and clips 13*a* , 13*b* form spaced three point attachment means to secure the bib in fixed relation to the infant. If the infant moves its body, the bottle holder attached to the bib will move in the same direction, thereby maintaining the bottle nipple in a position where the infant can reach it with his or her mouth.

Figure 2:
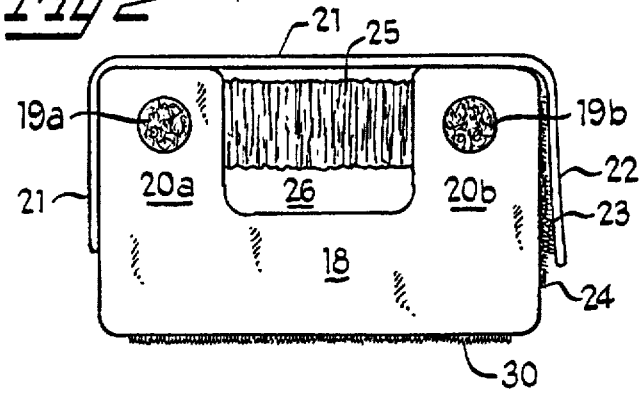
FIG. 2 is an elevational view of a baby bottle holding attachment.
Figure 5:
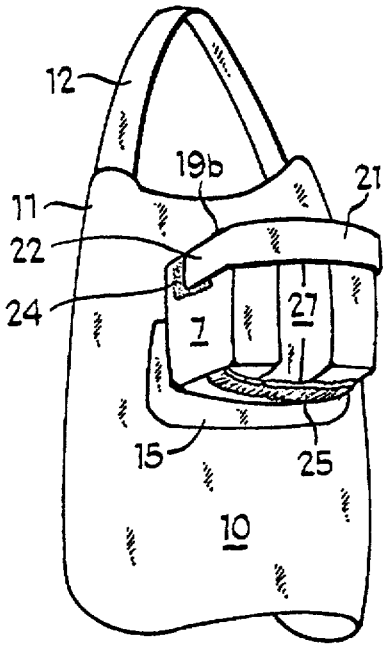
FIG. 5 is a perspective view of a bib with a baby bottle holding attachment attached thereto.
Figure 3:
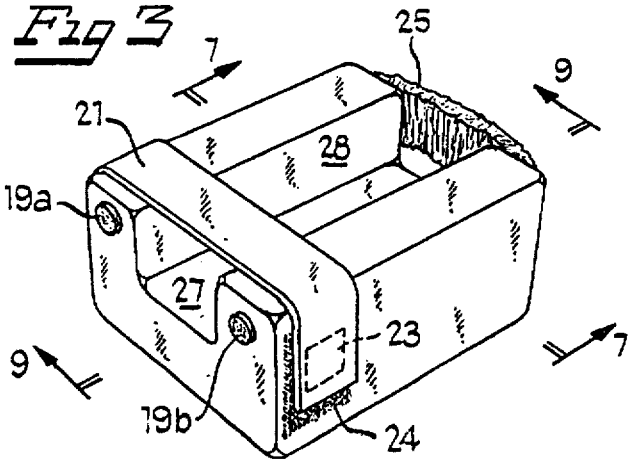
FIG. 3 is a perspective view of a baby bottle holding attachment.

FIG. 3 is a perspective view of the baby bottle holder while FIG. 2 is an elevational view looking at the bottle-holding attachment from the vantage point of an infant when the bottle-holding attachment is in place as shown in FIG. 5. This portion of the bottle-holding attachment which faces the infant is also that portion which is closest to the nipple of a bottle being held in position in the bottle-holding attachment and is referred to as the "top" or proximal position of the holder. The top panel 18 which is in the shape of a "U" in cross-section has two strips 19*a* and 19*b* of material which adheres when pressed together (e.g. VELCRO®) attached to each leg 20*a* and 20*b* of the "U" so that the baby bottle-holding attachment could be repositioned by attaching these strips 19*a* and 19*b* to the strip 14 attached to the bib 10. The bottle-holding attachment can be oriented or rotated 90 degrees to attach the dual adhering strips 19*a* and 19*b* to the adhering strip 14 on the bib face panel. A loop or strap 21 encompasses the face or front portion of the bottle-holding attachment as shown in FIG. 2. One end of strap 21 is stitched to a side panel of the bottle holder while the free end 22 has an adhering patch 23 (e.g. VELCRO®) which is secured to a correlative patch 24 on the opposite side of the baby bottle-holding attachment. A foot strap or bottle restraining means 25 is also illustrated which is attached across the base or foot of the bottle-holding attachment to serve as a rest for the bottom of a baby bottle. The foot strap 25 is preferably elastomeric or elasticized so that it may stretch to accommodate a large sized baby bottle as well as a small sized one.

The baby bottle-holding attachment is shown in perspective view in FIG. 3. The bottle holding device illustrated in FIG. 3 has a U-shaped channel-like member or housing formed from an internal flexible foam structure. The channel-like member is generally about two to four inches in length with an overall height of about two to three inches and width of about three to four inches.

Figure 6:
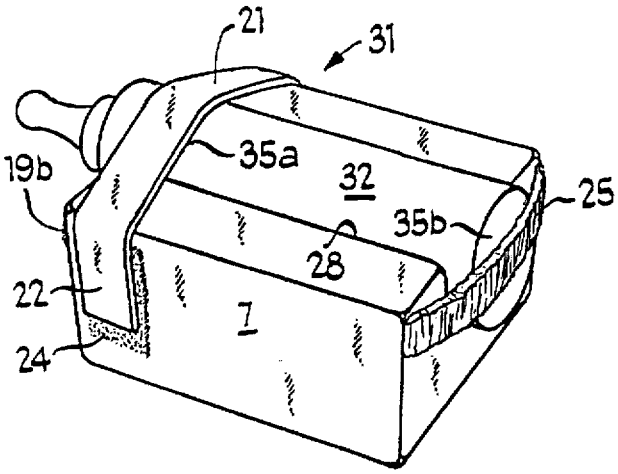
FIG. 6 is a perspective view of a baby bottle holding attachment with a baby bottle being retained therein.

The inner groove or trough 26 of the channel-like member is sized and structured to hold, for example, either a four- or eight-ounce baby bottle (or substantial metric equivalents thereof), as illustrated in FIG. 6. The U-shaped channel is bounded by its base 27 and opposed sidewalls 28 and 29.

Figure 9:
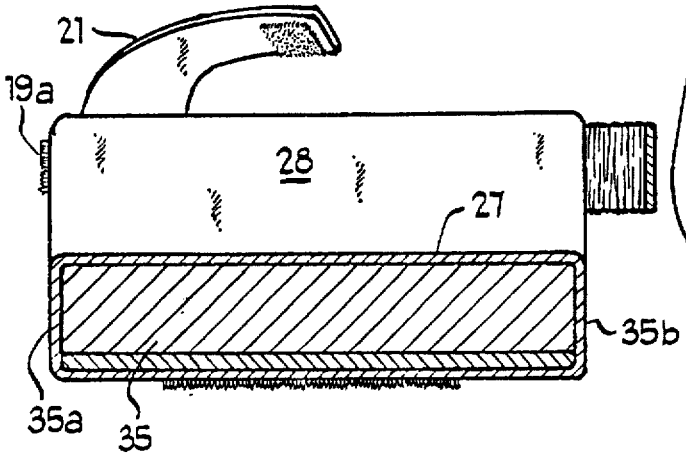
FIG. 9 is a cross-sectional view taken along section lines 9—9 of the bottle holding attachment of FIG. 3.

The holder illustrated in FIGS. 3 and 6 is preferably constructed so that the base of the trough 26 is inclined a slight amount to position the bottom of a baby bottle 32 higher than its top when residing in the trough. The incline of the trough is illustrated in FIG. 9, which shows the trough base surface 27 inclined and base member 35 having a height at its top end (proximal end) 35*a* which is much less than at its distal end 35*b*.

The bottom portion of the channel-like member has a flexible strap 25 across the end of the groove opening. The bottom of a baby bottle 32 held by the bottle holder contacts the flexible strap. The strap keeps the baby bottle 32 in position longitudinally, as shown in FIG. 6.

Figure 7:
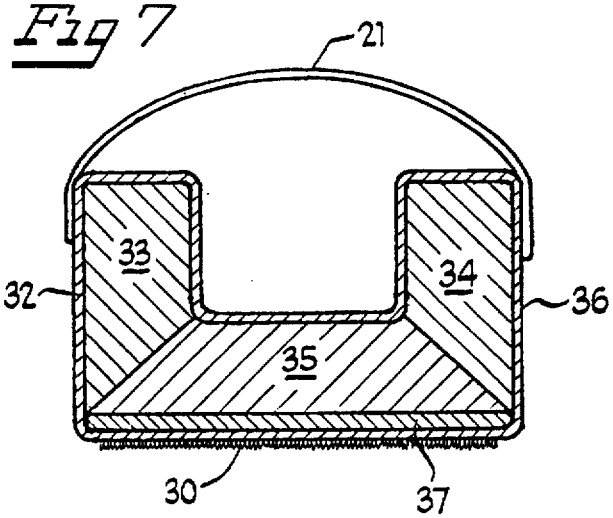
FIG. 7 is a cross-sectional view along section lines 7—7 of the bottle holding attachment of FIG. 3.

In one particular embodiment, the channel-like member has a foam core (U-shaped), see FIG. 7, that is about one inch or more in thickness although a hard or stiff material may be used as a core of the channel-like member. The foam core is covered by a fabric and the back of the bottle holder may have a rigid panel, e.g. cardboard, to give support where the holder attaches to a bib. The foam core may be formed from a single foam block with the trough cut into the block.

Figure 4:
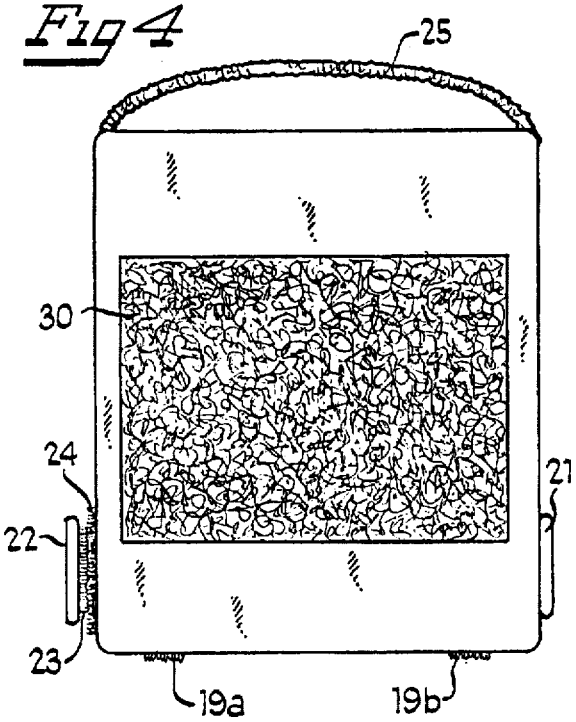
FIG. 4 is a planar view of the back of the baby bottle holding attachment.

FIG. 4 is a plan view showing the back or reverse side of the baby bottle-holder attachment where a large strip 30 of adhering material (e.g. VELCRO®) is attached to the back and is attachable to the strip 14 on the face of the bib illustrated in FIG. 1. A loop member or strap 25 is attached to either side and this forms a stop or rest for a baby bottle held in the slot or channel of the baby bottle holder. A pair of adhering strips 19*a* and 19*b* are illustrated in FIG. 4 as being attached to the proximal panel. The proximal side is the side which is typically facing an infant when the baby bottle holder is in use. Also shown in FIG. 4 is the end of strap or loop member 22 which goes across the top of upward portion of the baby bottle holder and is shown in FIG. 3 in an unattached manner.

FIG. 5 is a perspective view of a bib 10 with a baby bottle holder 31 attached. The bib panel member has clips 13*a* and 13*b* or attachment means for holding down the bib to a baby's sleeper or other garment. The baby bottle holder 31 is shown attached by adhering (e.g. VELCRO®) means to the bib panel member at about a position two-thirds to three-fourths of the way up the bib from the bottom of the bib.

FIG. 6 is a perspective view of the baby bottle holder 31 with a small baby bottle 32 in place. Loop or strap member 25 is shown across the bottom of the baby bottle while loop or strap member 21 is shown holding the baby bottle down in the channel of the baby bottle holder.

FIG. 7 is a cross-sectional view of the baby bottle-holder attachment showing a foam core 32 which may be made by three separate mitered panels, a pair of upright walls 33 and 34 and a base member 35, all of which are glued together to form a U-shaped structure. Alternatively, a trough may be cut into a single block of foam to form the U-shaped channel member. A cloth outer covering 36 covers the foam. The whole structure is made to be washable. The large adhering (e.g. VELCRO®) member 30 on the reverse or back side of the bottle holder is shown as well as the top loop 21 which holds the baby bottle down into the channel. A thin stiffening panel or slab member 37 is positioned between the foam core and the cloth covering to provide good structural support for swatch 30. The stiffener may be any water-resistant, substantially rigid plate or panel. It may be wood or plastic.

Figure 8:
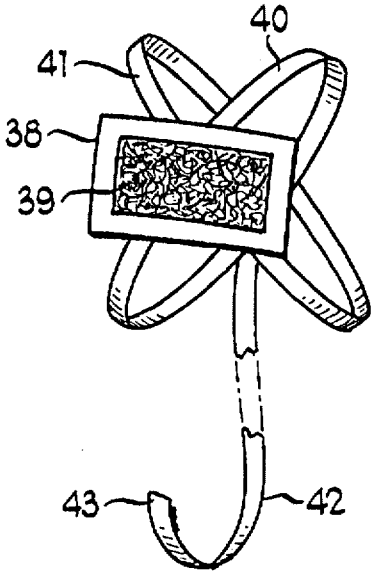
FIG. 8 is a bibless harness for holding the baby bottle holding attachment in proper position on a suckling infant.

FIG. 8 is an alternative means for holding the baby bottle attachment holder in place for sucking by an infant when a bib is not used. A harness is formed from a large panel 38 containing a strip 39 of adhering material (e.g. VELCRO®) which is supported or attached to cross-strap members 40 and 41. These cross-strap members may be elasticized so they fit over the shoulders and under the arm pits of an infant to hold the face panel 38 of the harness in place. A bottom loop member 42, which has a free end, is attached to the back of the cross straps, that is to the cross straps where the straps would cross in back of the infant wearing such a harness. The bottom loop 42 may be brought up under the crotch of an infant to have its free end 43 attached by adhering material (e.g. a VELCRO® swatch) to a corresponding face adhering panel 38 also so that the harness is held firmly in place. Such a structure may be used if an infant is wearing only a diaper and is not wearing any bib or other clothing, for example, when the weather is hot.

In the instant invention, the holding or gripping means may be of the adhering-type (e.g. VELCRO®) J-loop holders or metal snaps, buttons or the like. For example, patches 14 and 16 may be replaced by a pair of snaps, or a quartet of snaps if desired. Also, patch 17 may be replaced with a snap or button. Patches 19*a* and 19*b* may be replaced with snaps or also include snaps provided that patch 14 also has snaps. Patch 30 may contain snaps and attach to snaps on the bib face.

Figure 10:
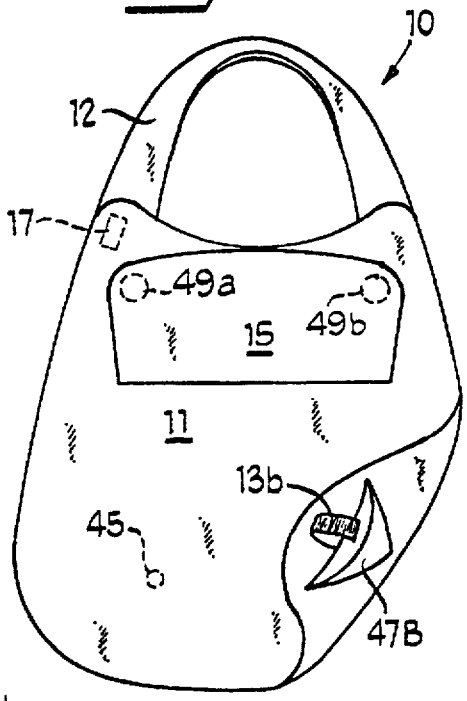
FIG. 10 is a planar view of a bib for use with the invention.

As shown in FIG. 10, the clips 13*a*, 13*b* are preferably associated with pockets or flaps 45*a*, 45*b* to prevent skin contact between the clips and the infant's skin, which might decrease discomfort to the child. The flap 15 is shown in a "closed" position, where the snap heads 49*a*, 49*b* have interacted with their corresponding members 51*a*, 51*b* to cover the swatch 14. Such a design aids in aesthetic manners, since the bib appears to be a normal bib when the bottle holding member is not associated with the remainder of the device. It also has practical utility in keeping the swatch debris free while the bottle holder is not in use with the bib 10.

After being apprised of the devices according to the invention, methods of making them will become readily apparent to those of skill in the art. For instance, the bib member and straps may be sewn or formed from fabric, plastic sheeting or similar flexible material. Snaps (e.g. LIGNE 16), clips (Elite Supply #C-40B), and eyelets (Fastener Supply Co. #A942) are all readily commercially available.

Although the invention has been described with rather specific details concerning materials, components and dimensions, it is to be understood that the invention is to be defined by the scope of the following claims.

What is claimed is:

1. A baby bib comprising:

a bib member having a front surface and a back surface;

an article accepting region associated with the front surface of the bib member;

means, associated with the article accepting region, for enabling the article accepting region to be altered from a first covered non-article accepting orientation to a second uncovered usable article accepting orientation;

means for attaching the bib member in a substantially immobile position relative to the clothing of an infant, wherein the bib attachment means are associated with the back surface of the bib member and are releasably securable to the clothing of the infant; and a flap for covering the bib attachment means so as to prevent the bib attachment means from contacting the infant's skin.

2. The baby bib of claim 1, wherein the bib attachment means is a spring loaded clip.

3. The baby bib according to claim 1, wherein the article accepting altering means comprises a flap.

4. The baby bib according to claim 1, further including means for holding a baby bottle.

5. The baby bib of claim 4, wherein said baby bottle holding means has detachable attachment means for attaching said baby bottle holding means to said article accepting region of the bib member when the article accepting altering means is in the uncovered usable article accepting orientation.

6. The baby bib according to claim 5, wherein the baby bottle holding means comprises a housing which surrounds at least a portion of the exterior surface of a baby bottle, the housing having an open proximal end and an open distal bottom end; and bottle restraining means associated proximate to the open distal end for predentin inadvertent longitudinal displacement of the baby bottle, the bottle restraining means comprising an elastomeric strap.

* * * * *